US008776758B2

(12) United States Patent
Melde-Tuczai et al.

(10) Patent No.: US 8,776,758 B2
(45) Date of Patent: Jul. 15, 2014

(54) INTERNAL COMBUSTION ENGINE HAVING A CYLINDER HEAD AND A CYLINDER BLOCK

(75) Inventors: Helmut Melde-Tuczai, Graz (AT); Christof Knollmayr, Graz (AT); Andreas Zurk, Weinburg (AT)

(73) Assignee: AVL List GmbH, Graz (AT)

( * ) Notice: Subject to any disclaimer, the term of this patent is extended or adjusted under 35 U.S.C. 154(b) by 121 days.

(21) Appl. No.: 13/512,654

(22) PCT Filed: Nov. 25, 2010

(86) PCT No.: PCT/EP2010/068179

§ 371 (c)(1),
(2), (4) Date: Jun. 18, 2012

(87) PCT Pub. No.: WO2011/067155

PCT Pub. Date: Jun. 9, 2011

(65) Prior Publication Data

US 2012/0260883 A1 Oct. 18, 2012

(30) Foreign Application Priority Data

Dec. 3, 2009 (AT) ..... A 1920/2009

(51) Int. Cl.

| | |
|---|---|
| ***F02B 75/22*** | (2006.01) |
| ***F01M 7/00*** | (2006.01) |
| ***F01M 1/02*** | (2006.01) |
| ***F02F 7/00*** | (2006.01) |
| ***F02F 1/00*** | (2006.01) |
| ***F02F 1/42*** | (2006.01) |
| ***F02F 1/16*** | (2006.01) |

(52) U.S. Cl.

CPC ..... *F02F 7/0007* (2013.01); *F02F 1/002* (2013.01); *F02F 1/4285* (2013.01); *F02F 1/16* (2013.01); *F01M 1/02* (2013.01); *F01M 2001/0284* (2013.01)

USPC ..... 123/196 R; 123/195 R; 123/195 H

(58) Field of Classification Search

CPC ..... F01M 7/00; F01M 2001/0284

USPC ..... 123/196 R, 195 R, 195 H

See application file for complete search history.

(56) References Cited

U.S. PATENT DOCUMENTS 4,295,807 A * 10/1981 Kruger ..... 418/170
4,616,610 A * 10/1986 Ishida ..... 123/196 A (Continued)

FOREIGN PATENT DOCUMENTS

DE 2444659 7/1975
DE 2501605 7/1975

(Continued)

OTHER PUBLICATIONS

English Abstract of JP 2000337117.

(Continued)

*Primary Examiner* — Lindsay Low
*Assistant Examiner* — Tea Holbrook
(74) *Attorney, Agent, or Firm* — Dykema Gossett PLLC

(57) ABSTRACT

An internal combustion engine (1), includes a cylinder head (2) and a cylinder block (3), with a crankcase (10) being fixed to the cylinder block (3), and with the crankcase (10) including at least one oil pump. In order to reduce the production effort the oil pump is arranged in the crankcase (10), with the oil pump (40) being connected with a flange (43), and with the flange (43) being fixed to a mounting wall (42) of the crankcase (10).

8 Claims, 6 Drawing Sheets

(56) References Cited

U.S. PATENT DOCUMENTS

| | | | | |
|---|---|---|---|---|
| 4,883,031 | A * | 11/1989 | Ampferer et al. | 123/195 C |
| 5,395,217 | A * | 3/1995 | Hoffmann et al. | 417/362 |
| 6,886,523 | B2 * | 5/2005 | Steffes et al. | 123/196 R |
| 7,191,871 | B2 * | 3/2007 | Nakai et al. | 184/6.5 |
| 2002/0023612 | A1 * | 2/2002 | Weindorf | 123/196 R |

FOREIGN PATENT DOCUMENTS

| | | | |
|---|---|---|---|
| DE | 3123527 | | 6/1982 |
| DE | 3506928 | | 8/1986 |
| DE | 19632024 | | 2/1998 |
| GB | 2316128 | A * | 2/1998 |
| GB | 2425570 | | 11/2006 |
| JP | 50156626 | | 12/1975 |
| JP | 2000337117 | | 12/2000 |

OTHER PUBLICATIONS

English Abstract of DE 19632024.
English Abstract of DE 3506928.

* cited by examiner

INTERNAL COMBUSTION ENGINE HAVING A CYLINDER HEAD AND A CYLINDER BLOCK

BACKGROUND OF THE INVENTION

1. Field of the Invention

The invention relates to an internal combustion engine which includes a cylinder head and a cylinder block, with a crankcase being fixed to the cylinder block, and with the crankcase including at least one oil pump.

2. The Prior Art

It is known to arrange the cylinder head and the cylinder block as a unit. Such head-cylinder-block units are also known as monoblocs. An integral crankcase is usually adjacent to the head-block unit. Furthermore, internal combustion engines with multi-part crankcases are known, with one crankcase part and bearing bracket for the crankshaft bearing being cast together into one piece. This component is also known as "bed plate". In the case of monobloc internal combustion engines, individual bearing blocks with individual bearing brackets were used up until now in order to enable the necessary accessibility for machining the cylinder bores.

An internal combustion engine with cylinder head and cylinder block is known from GB 2 425 570 B, with the cylinder head and the cylinder block being integrally arranged.

It is known from JP 2000-337117 A to fix an oil pump having an integrated control valve by means of screws from the outside to the crankcase. The mounting opening will simultaneously be sealed in an oil-tight manner by the flange of the intake line. It is disadvantageous that there is a relatively large number of areas that need to be machined.

It is the object of the invention to reduce the machining effort in an internal combustion engine of the kind mentioned above.

SUMMARY OF THE INVENTION

This is achieved in accordance with the invention in such a way that the oil pump is arranged in the crankcase, with the oil pump being connected with a flange, and with the flange being fixed to a mounting wall of the crankcase.

Simple fixing with little machining effort can be achieved when the flange is connected with the mounting wall by at least one first screw and the oil pump with the flange by at least one second screw, with preferably the second screws being longer than the first screws.

It is especially advantageous when the oil pump is arranged on an inside surface of the mounting wall, with preferably the flange being arranged on an outside surface of the mounting wall, with the first and second screws being insertable into respective screw boreholes from the flange side. The oil pump is fixed by the flange to the second part of the crankcase. Said flange is arranged in such a way that the first screws for the pump and the second screws for the flange are disposed on the same side, which is the outside of the crankcase. The flange is pressed with the short first screws against the clamping surface of the first part of the crankcase and the oil pump is pulled by the long second screws against the face surface of the flange. The advantage of this arrangement is that only a machining of the clamping surface and the centering bore for the flange is necessary from the outside in order to install the oil pump in the interior of the bottom part.

The machining effort can be reduced substantially especially in the case of internal combustion engines with an integral head-block unit formed by the cylinder head and the cylinder block. It is preferably provided further that the crankcase consists of a first part adjacent to the head-block unit and a second part adjacent to the first part, with the first and the second part being divided in a plane containing the axis of a crankshaft, preferably normal to the cylinder axes, with preferably the first and/or the second part forming at least one main bearing for the crankshaft. Preferably, the oil pump is arranged in the second part of the crankcase. An arrangement in the first part is also alternatively possible.

The invention will be explained below in greater detail by reference to the drawings:

DETAILED DESCRIPTION OF THE PREFERRED EMBODIMENT

Figure 1:
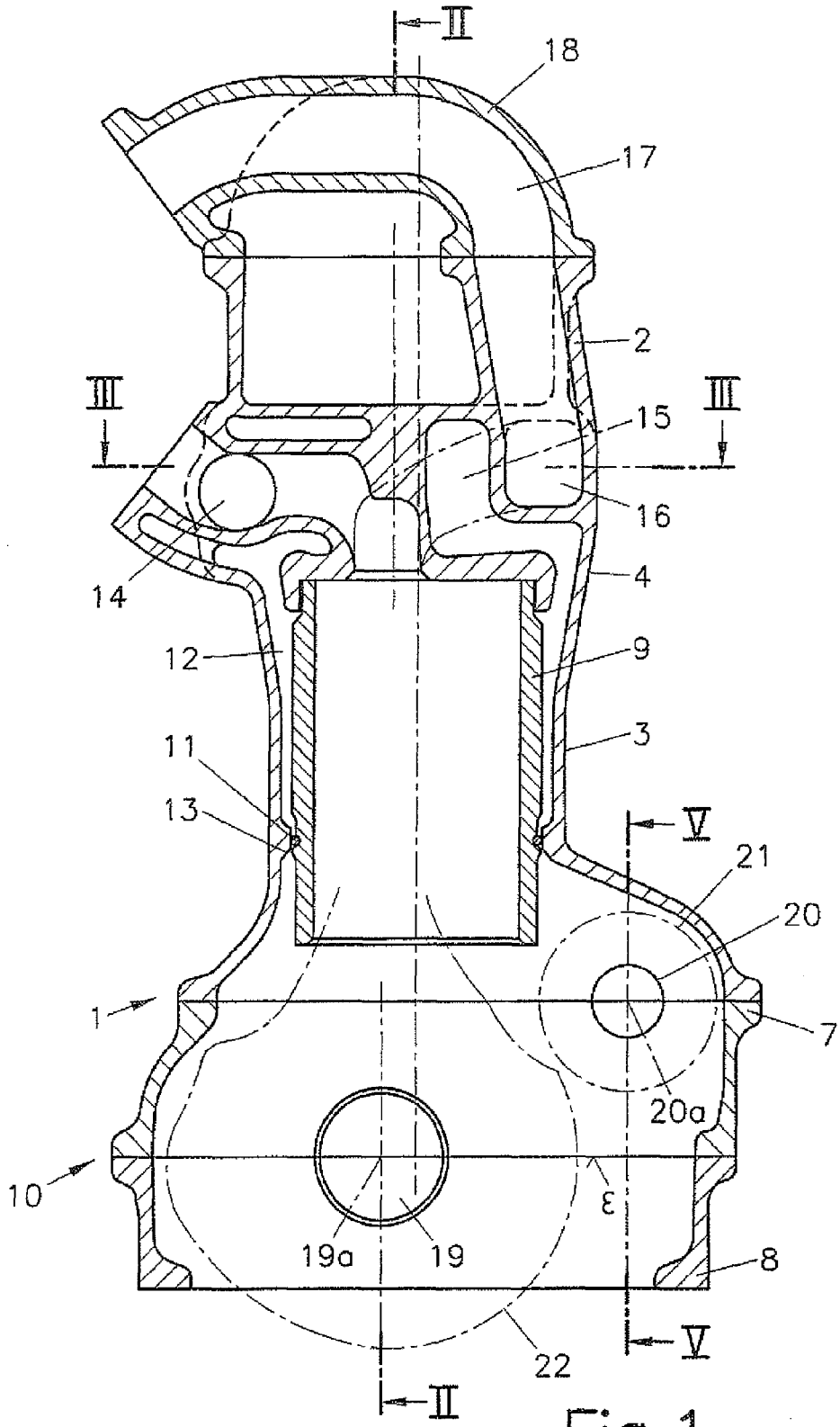
FIG. 1 shows an internal combustion engine in accordance with the invention in a sectional view along the line I-I in FIG. 2.
Figure 2:
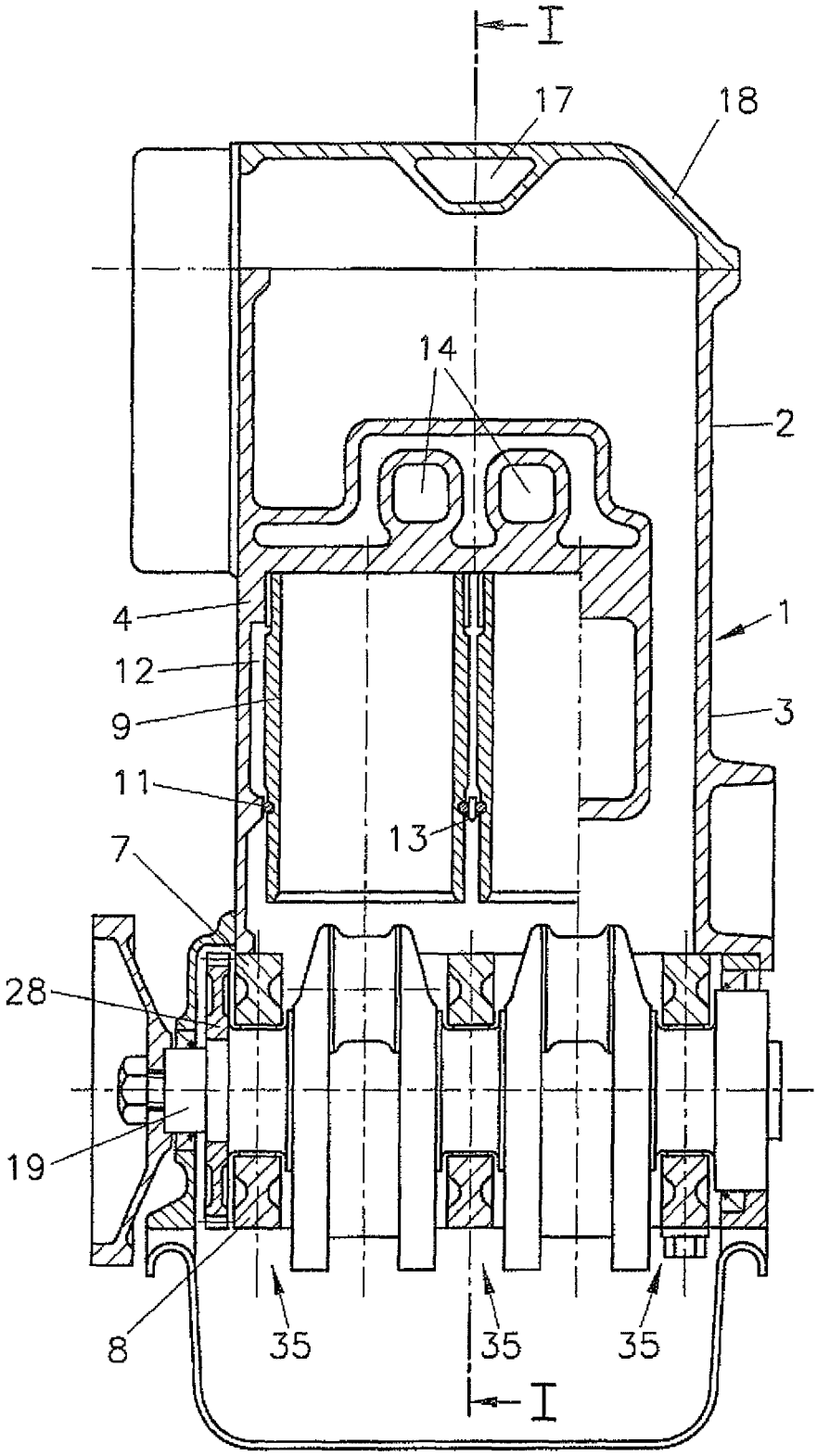
FIG. 2 shows the internal combustion engine in a sectional view along the line II-II in FIG. 1.
Figure 3:
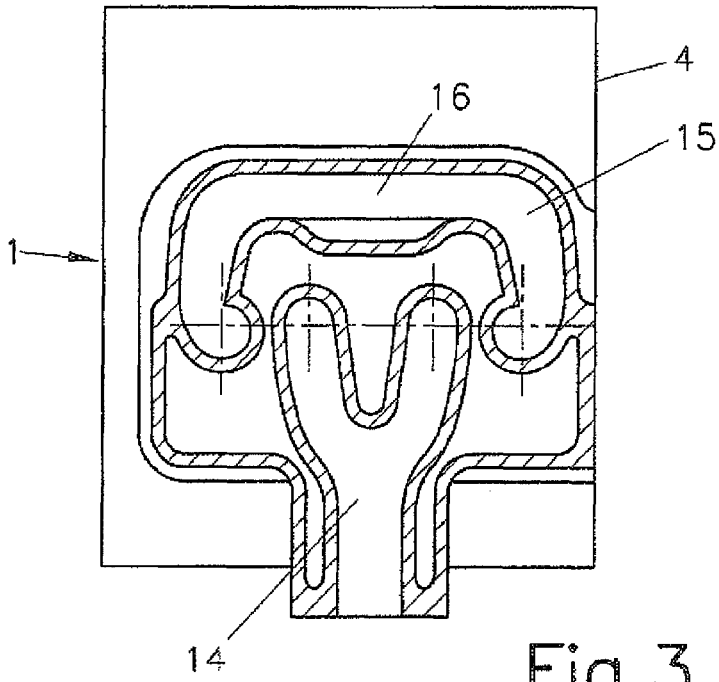
FIG. 3 shows the internal combustion engine in a sectional view along the line III-III in FIG. 1.
Figure 4:
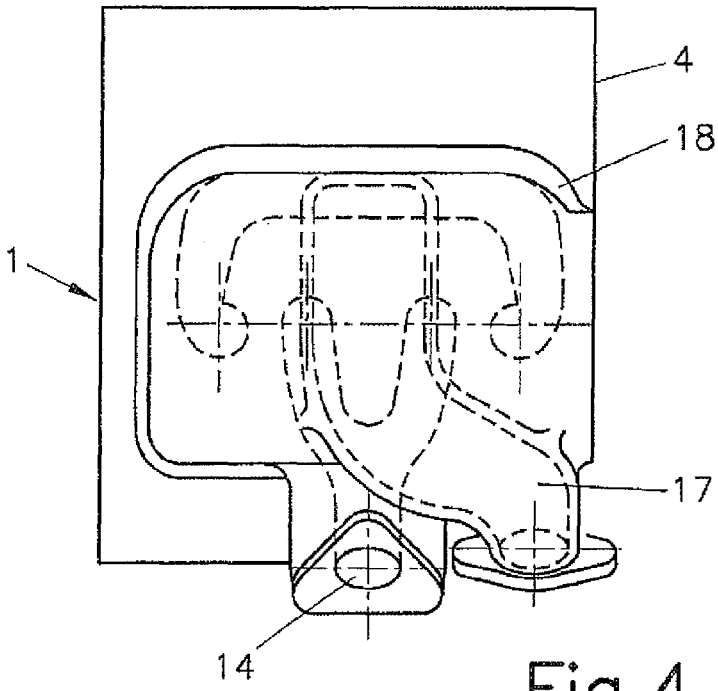
FIG. 4 shows the internal combustion engine in a top view.

FIGS. 1 to 4 show an internal combustion engine 1 with a cylinder head 2 and a cylinder block 3, with the cylinder head 2 and the cylinder block 3 being arranged in an integral fashion to form a head-block unit 4. A crankcase 10 is adjacent to the head-block unit 4, which crankcase consists of an upper first part 7 and a bottom second part 8. The cylinder liners 9 are screwed into the head-block unit 4. It is also possible alternatively to arrange the cylinder liners 9 integrally with the head-block unit 4.

The head-block unit 4, the first part 7 and the second part 8 of the crankcase 10 can consist of different materials. An especially light crankcase 10 can be realized when all components are made of light metal. It is alternatively also possible to make the head-block unit 4 and the first part 7 of light metal, and to make the cylinder liners 9 and the highly loaded second part 8 of gray cast iron. The distance between the individual cylinders arises from the condition that a complete mounting chamfer 13 needs to be arranged for the O-ring seal 11 of the cooling water chamber 12. In the case of the integral cylinder liner, the cylinder distance will be smaller. The two-part crankcase 10 can accommodate at least one mass balancing shaft 20, at least one injection-pump drive shaft and/or at least one oil pump 30.

As is shown in FIGS. 1 to 4, the outlet lines 14 can be integrated in the head-block unit 4. Furthermore, the inlet lines 15 and the inlet collector 16 can also be integrated partly in the head-block unit 4. Especially in the case of a gasoline engine, long feed lines 17 ("ram pipes") can be housed in the cylinder head cover 18 and the head-block unit 4. The inlet collector 16 lies in this case at a lower position.

Figure 5:
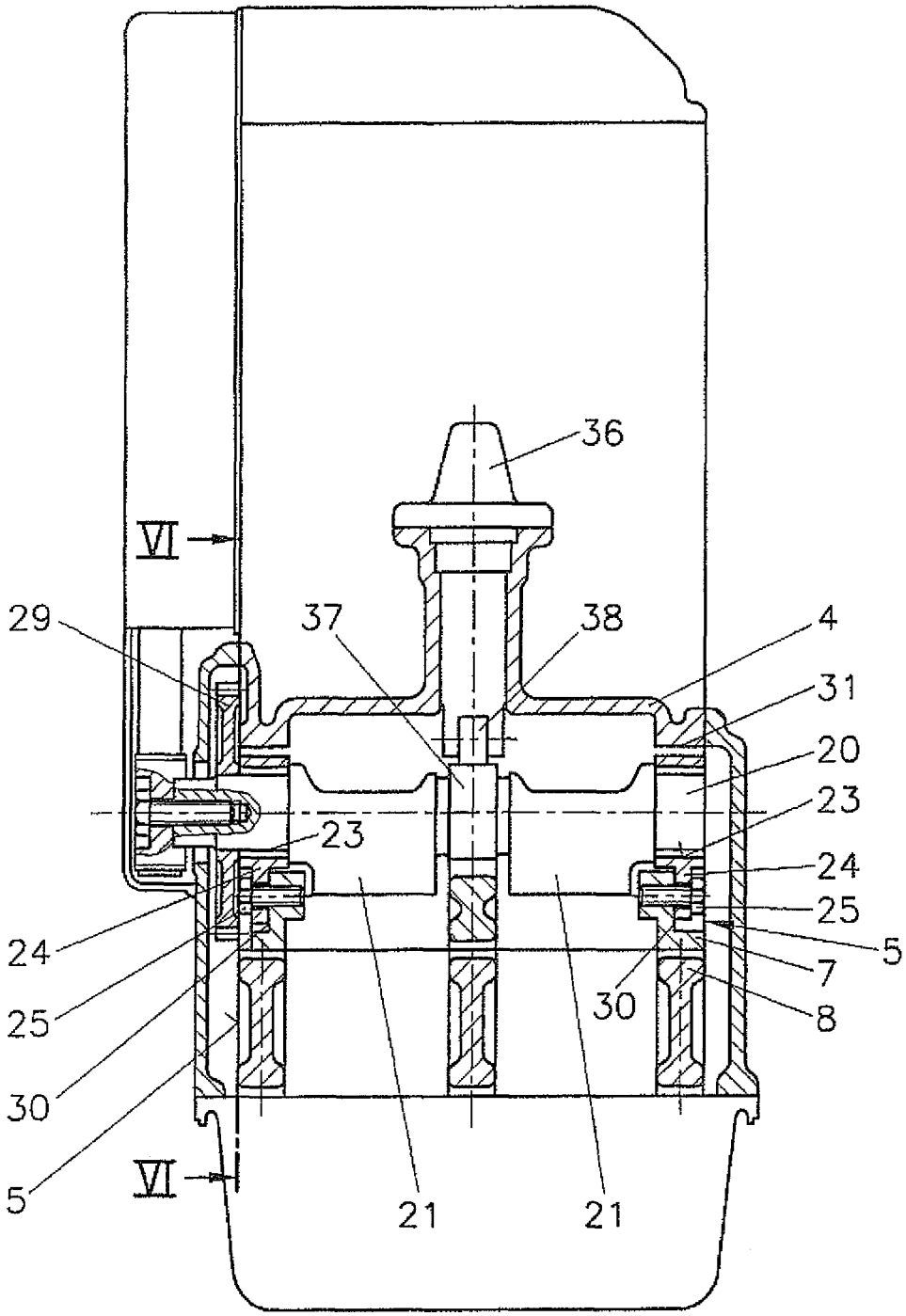
FIG. 5 shows the internal combustion engine in accordance with the invention in a sectional view along the line V-V in FIG. 1.
Figure 6:
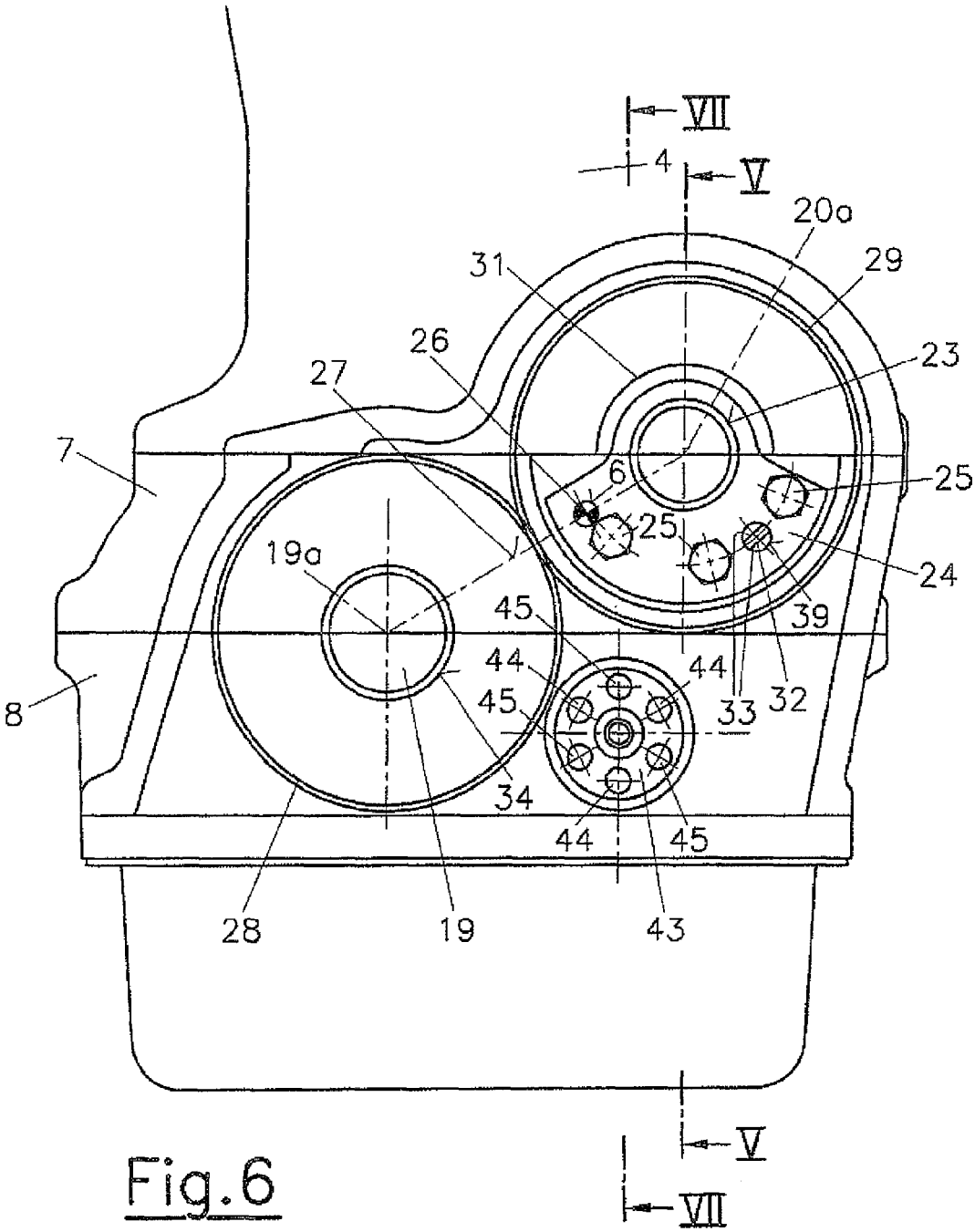
FIG. 6 shows the internal combustion engine in a view along the line VI-VI in FIG. 5.

As is shown in FIG. 1, FIG. 5, and FIG. 6, the mass balancing shaft 20 can be integrated in the first part 7. The position of the mass balancing shaft 20 will be found in such a way that the balance weights 21 of the mass balancing shaft 20 are able to rotate with sufficient distance from the envelope 22 of the connecting rod (not shown in closer detail), wherein the axis 20*a* of the mass balancing shaft 20 does not necessarily have to lie in the plane ϵ of the axis 19*a* of the crankshaft 19. In order to ensure that the machining of the bearing bores 23 can occur independent from the head-block unit 4, the bearing bores 23 are housed in the flanged bushes 24. They are fixed with flange screws 25 in the first part 7. A first pin 26 which is arranged as an alignment pin is arranged on the straight connecting line 27 between the axis 19*a* of the crankshaft 19 and the axis 20*a* of the mass balancing shaft 20 at a precisely defined distance to the axis 19*a* of the crankshaft 19 in the region of the face sides 5 of the first part 7. The first pin 26 is guided in a borehole 6 of the flanged bush 24 and keeps the necessary distance for the engagement of the two gearwheels 28, 29 for driving the mass balancing shaft 20 by the crankshaft 19.

The machining of the area 30 for fixing the flanged bushes 24 in the first part 7 can occur from the outside. A respective recess 31 for accommodating the flanged bushes 24 is provided in the head-block unit 4.

A second pin 32 with two flattened portions in its cross-section is further provided in the region of the face side 5 of the first part 7 in order to ensure parallelism of the mass balancing shaft 20 in relation to the crankshaft 19. The two flattened portions 33 are aligned parallel to the connecting line 27 between the axis 19*a* of the crankshaft 19 and the axis 20*a* of the mass balancing shaft 20. The flanged bush 24 comprises a guide opening 39 which corresponds with the second pin 32. As a result, the flanged bush 24 can be pivoted about the first pin 26 without leading to any disadvantages for the tooth engagement of the two gearwheels 28, 29.

In this way, the receiving bores 34 for the main bearings 35 of the crankshaft 19 and the bearing bores 23 in the flanged bushes 24 can be machined independent from the head-block unit 4 in one clamping.

The drive of the mass balancing shaft 20 can also occur with a chain instead of the gearwheels 28, 29.

As is shown in FIG. 5, the mass balancing shaft 20 can also be arranged for driving an injection pump 36. The mass balancing shaft 20 comprises a cam 37 for this purpose which acts upon the drive tappet 38 of the injection pump 36. The position of the cam 37 can be chosen at will and can also be provided in the region of the bearing on the side of the flywheel as an alternative to the symmetrical arrangement as shown in FIG. 5.

Furthermore, an oil pump 40 can also be arranged in the crankcase 10, i.e. either in the first part 7 or in the second part 8.

Figure 7:
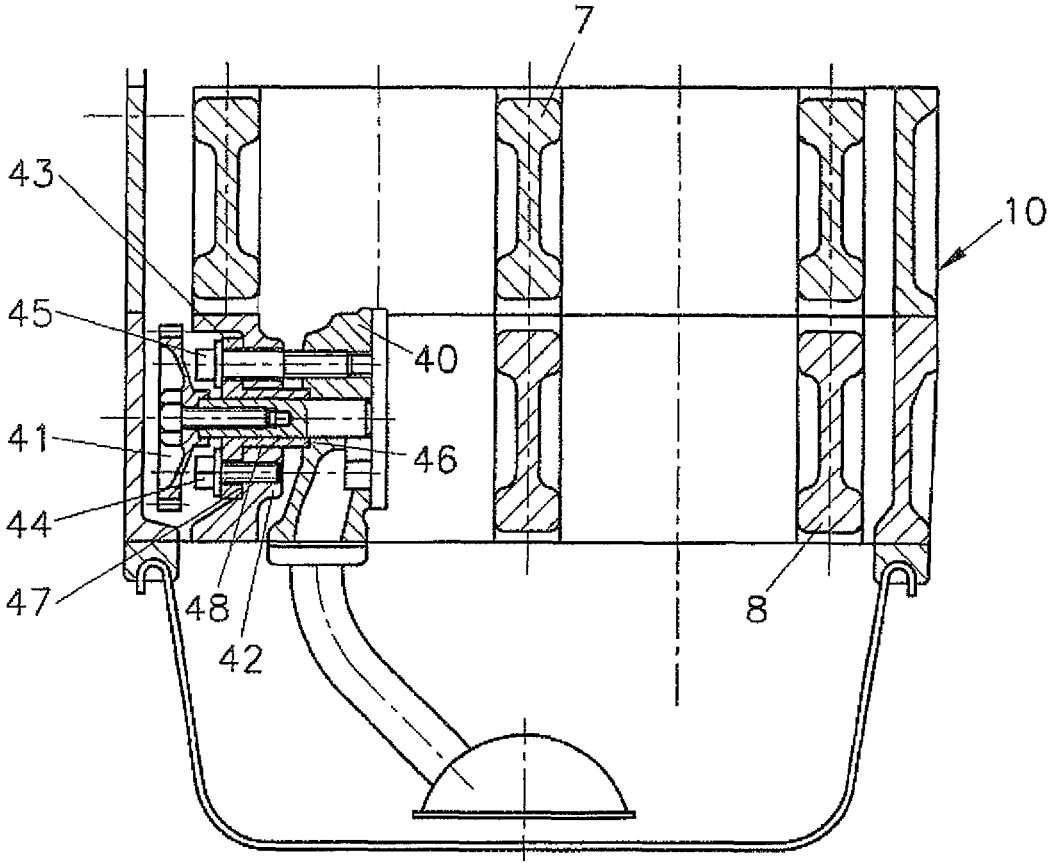
FIG. 7 shows the internal combustion engine in a further sectional view through the crankcase along the line VII-VII in FIG. 6.

FIG. 7 shows an embodiment in which the oil pump 40 is positioned in the second part 8. The drive of the oil pump 40 occurs via the crankshaft 19 by the drive gearwheel 41. For the purpose of fixing the oil pump 40, a flange 43 is inserted into a mounting wall 42 of the second part 8. The flange 43 is fixed by short first screws 44 to the mounting wall 42 of the second part 8. Long second screws 45 pull the oil pump 40 against the face side 46 of the flange 43. As a result, the oil pump 40 is not pressed by internal screws against the second part 8, but is drawn by external second screws 45 against the face surface 46 of the flange 43.

The screws 44, 45 for fixing the flange 43 and the oil pump 40 are arranged on the same externally accessible side of the crankcase 10.

The advantage of this arrangement is that only one machining of the clamping surface 47 and the centering borehole 48 for the flange 43 is necessary from the outside in order to install the oil pump 40 in the interior of the crankcase 10.

The drive of the oil pump 40 can also occur via a chain (not shown in greater detail) as an alternative to the drive via the drive gearwheel 41.

The invention claimed is:

1. An internal combustion engine, comprising a cylinder head and a cylinder block, with a crankcase being fixed to the cylinder block, and with the crankcase enclosing at least one oil pump, with the oil pump being connected with a flange fixed to a mounting wall inside the crankcase, wherein the flange comprises a face side protruding into an interior of the crankcase and which is spaced from the mounting wall, and wherein the oil pump is fastened by at least one screw against the face side of the flange.

2. The internal combustion engine according to claim 1, wherein the flange is connected with the mounting wall via at least one first screw and the oil pump is connected with the flange via at least one second screw, and wherein the at least one second screw is longer than the at least one first screw.

3. The internal combustion engine according to claim 2, wherein the at least one first screw is screwed into a first threaded bore of the mounting wall and the at least one second screw is screwed into a second threaded bore of the oil pump penetrating the mounting wall between the flange and the oil pump.

4. The internal combustion engine according to claim 1, wherein the oil pump is arranged on an inside surface of the mounting wall.

5. The internal combustion engine according to claim 4, wherein the flange is arranged on an outside surface of the mounting wall, and wherein the first and second screws are mountable from the flange side.

6. The internal combustion engine according to claim 1, wherein the cylinder head and the cylinder block constitute a one piece head-block unit.

7. The internal combustion engine according to claim 6, wherein the crankcase consists of a first part adjacent to the head-block unit and a second part adjacent to the first part, with the first and second parts being divided in a plane (ϵ) containing an axis of a crankshaft.

8. The internal combustion engine according to claim 7, wherein the oil pump is located in the second part.

* * * * *